US007170366B2

(12) United States Patent
Baird

(10) Patent No.: US 7,170,366 B2
(45) Date of Patent: Jan. 30, 2007

(54) WAVEGUIDE TO MICROSTRIP TRANSITION WITH A 90° BEND PROBE FOR USE IN A CIRCULARLY POLARIZED FEED

(75) Inventor: Andrew Baird, Bramley (GB)

(73) Assignee: Andrew Corporation, Westchester, IL (US)

( * ) Notice: Subject to any disclaimer, the term of this patent is extended or adjusted under 35 U.S.C. 154(b) by 0 days.

(21) Appl. No.: 10/907,329

(22) Filed: Mar. 29, 2005

(65) Prior Publication Data

US 2006/0181365 A1 Aug. 17, 2006

Related U.S. Application Data

(63) Continuation-in-part of application No. 10/906,273, filed on Feb. 11, 2005.

(51) Int. Cl.
*H01P 1/161* (2006.01)
*H01P 5/103* (2006.01)

(52) U.S. Cl. ..... 333/21 A; 333/26

(58) Field of Classification Search ..... 333/26, 333/21 A

See application file for complete search history.

(56) References Cited

U.S. PATENT DOCUMENTS

| | | | | |
|---|---|---|---|---|
| 2,825,876 A | | 3/1958 | Le Vine et al. | |
| 2,979,676 A | | 4/1961 | Rueger | |
| 3,681,714 A | | 8/1972 | Terakawa | |
| 3,969,691 A | | 7/1976 | Saul | |
| 4,453,142 A | | 6/1984 | Murphy | |
| 4,716,387 A | * | 12/1987 | Igarashi | 333/26 |
| 4,754,239 A | | 6/1988 | Sedivec | |
| 5,258,727 A | | 11/1993 | Dupuis et al. | |
| 5,331,332 A | | 7/1994 | West et al. | |
| 5,359,339 A | * | 10/1994 | Agrawal et al. | 343/786 |
| 5,361,049 A | | 11/1994 | Rubin et al. | |
| 5,559,480 A | | 9/1996 | Ivanivsky | |
| 6,509,809 B1 | | 1/2003 | Lynch | |
| 2002/0005806 A1 | | 1/2002 | Perrott et al. | |

FOREIGN PATENT DOCUMENTS

| | | |
|---|---|---|
| FR | 2729011 | 7/1996 |
| GB | 2334153 | 8/1999 |
| JP | 2000269709 | 9/2000 |

* cited by examiner

*Primary Examiner*—Benny Lee
(74) *Attorney, Agent, or Firm*—Babcock IP, PLLC

(57) ABSTRACT

A first waveguide to microstrip transition, the waveguide having a top, a bottom, a first sidewall, a second sidewall and a closed end. A transition slot normal to a longitudinal axis of the waveguide intersects the top and the first sidewall. A probe having a 90 degree bend is arranged in the transition slot, a distal end of the probe projecting into the waveguide normal to the top. A proximal end of the probe is coupled to a microstrip on a dielectric substrate. An impedance matching feature may be included projecting from the bottom, proximate the distal end of the probe. A hole may be formed in the dielectric substrate proximate the proximal end of the probe. A second waveguide and transition arrangement may be aligned bottom to bottom with the first waveguide and similarly arranged with a probe coupled to a second microstrip on the dielectric substrate.

13 Claims, 7 Drawing Sheets

WAVEGUIDE TO MICROSTRIP TRANSITION WITH A 90° BEND PROBE FOR USE IN A CIRCULARLY POLARIZED FEED

CROSS REFERENCE TO RELATED APPLICATIONS

This application is a continuation-in-part of U.S. patent application Ser. No. 10/906,273 titled "Multiple Beam Feed Assembly", filed 11 Feb. 2005 by Andrew Baird and Neil Wolfenden, owned by Andrew Corporation as is the present application, hereby incorporated by reference in the entirety.

BACKGROUND

RF signals conducted by rectangular waveguides propagating in transverse electric propagation mode are converted to transverse electromagnetic mode at a transition between the waveguide and a microstrip conductor. Insertion loss, return loss and impedance matching are important factors of waveguide to microstrip transition performance. Another factor is bandwidth, which is related to the impedance match at the transition.

Waveguide to microstrip transitions incorporated, for example, in the feed assembly of a reflector antenna are subject to space and orientation constraints applied to minimize the overall dimensions of the feed assembly. Further, transition layout conflicts may arise between space requirements of transitions from adjacent feed waveguides of a multiple narrow beam feed assembly.

Prior waveguide to microstrip transitions have included waveguide tapering structures designed to concentrate the RF signal in the waveguide upon a microstrip inserted in-line within the waveguide end. However, these structures require a significant longitudinal dimension that may conflict with adjacent circuit structures and or result in an assembly that is unacceptably deep. Alternatively, traces upon a PCB have been inserted into a waveguide, normal to the waveguide but this also constrains the orientation of the PCB or requires a further angular transition to yet another PCB.

The increasing competition for mass market consumer reflector antennas and thereby for the subcomponents thereof such as feed assemblies has focused attention on cost reductions resulting from increased materials, manufacturing and service efficiencies. Further, reductions in required assembly operations and the total number of discrete parts are desired.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with the general and detailed descriptions of the invention appearing herein, serve to explain the principles of the invention.

DETAILED DESCRIPTION

Figure 1:
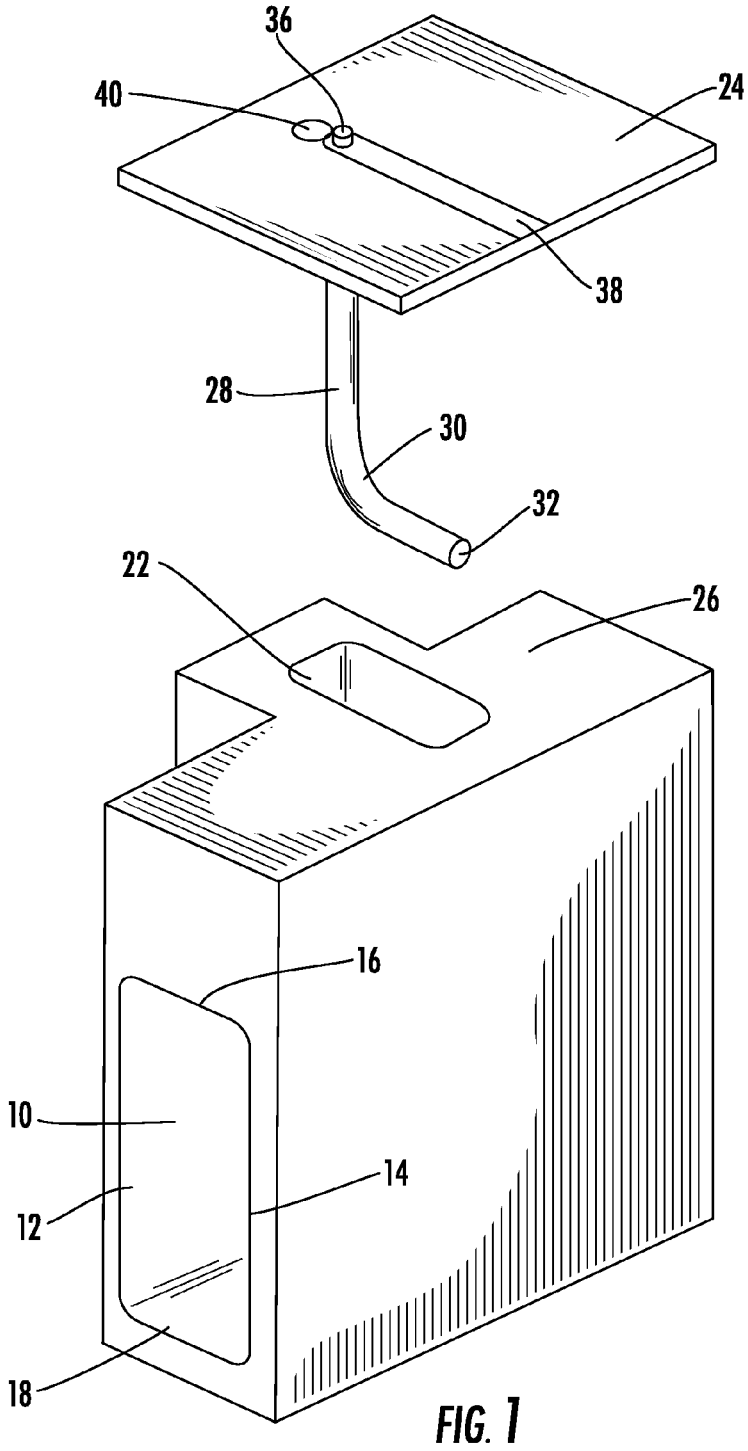
FIG. 1 is a schematic exploded isometric view of a waveguide to microstrip transition according to an exemplary embodiment of the invention.
Figure 2:
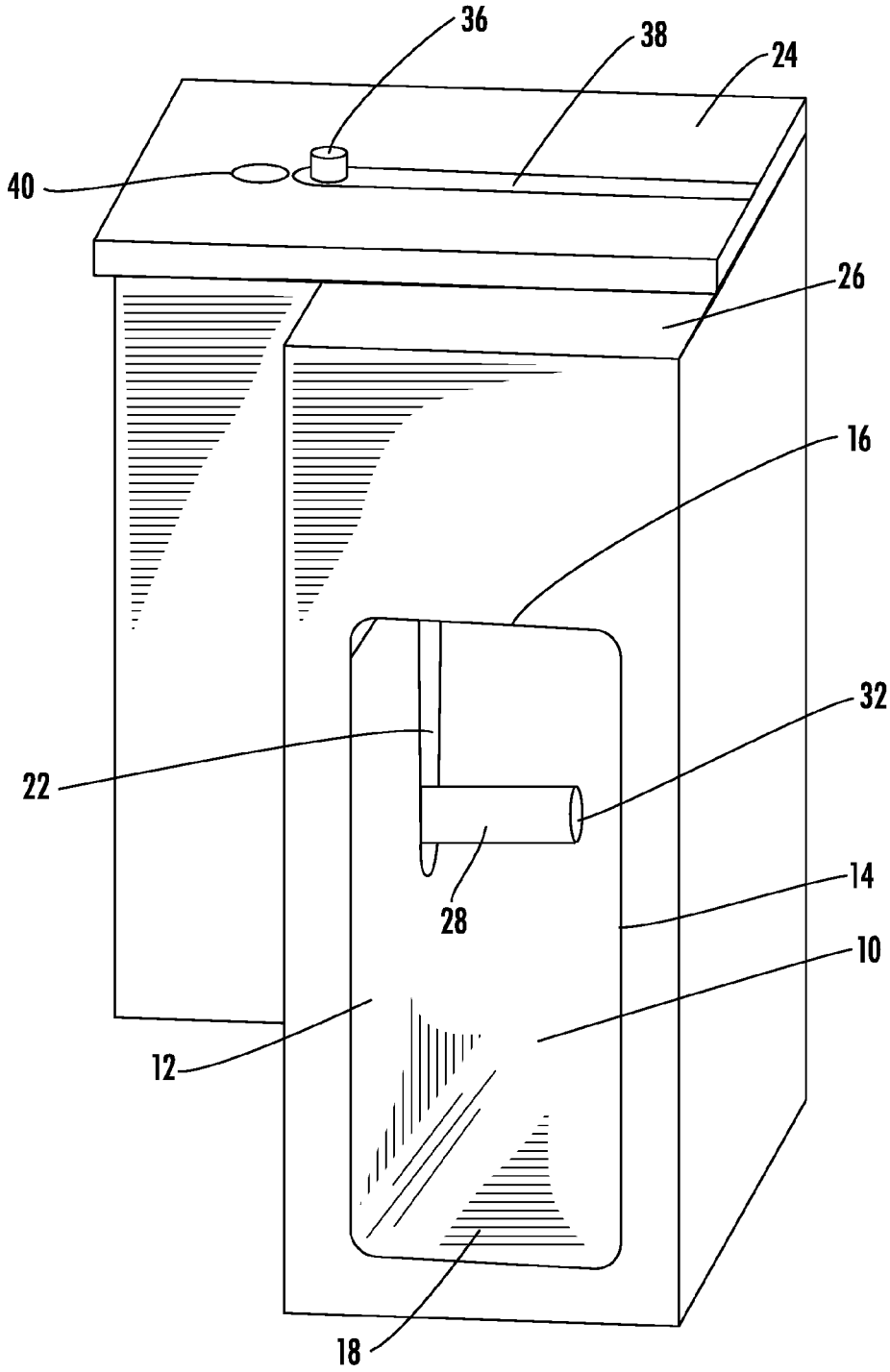
FIG. 2 is an angled front side isometric view of the transition of FIG. 1, assembled.

The invention is described with reference to an exemplary embodiment as shown in FIGS. 1–5, where like features in the different drawing figures are denoted by the same reference numbers. A first waveguide 10 is generally rectangular, having a top 12, a bottom 14, a first sidewall 16 and a second sidewall 18. The first waveguide 10 terminates at a closed end 20. A transition slot 22 normal to a longitudinal axis of the first waveguide 10 intersects the top 10 and the first sidewall 16 of the first waveguide 10. The transition slot 22, extending to a dielectric substrate 24 mounting surface 26 parallel to the first sidewall 16, is dimensioned to accommodate a probe 28 spaced away from the transition slot 22 side walls.

A probe 28 having a 90 degree bend 30 (best seen in FIG. 1) is arranged in the transition slot 22, a distal end 32 of the probe 28 projecting into the first waveguide 10 normal to the top 12. The distal end 32 of the probe 28 preferably extends into the first waveguide 10 more than half a distance between the top 12 and the bottom 14 proximate an impedance matching feature 34 projecting from the bottom 14. The proximal end 36 of the probe 28 passes through a dielectric substrate 24 to couple with a first microstrip 38 formed as a conductor on the dielectric substrate 24, for example, as a trace upon a printed circuit board.

The probe 28 may be formed from metal wire having a circular cross section with a diameter selected to give the probe sufficient rigidity so that external vibrations of the surrounding assembly do not short the probe against the transition slot 22 side walls.

The transition slot 22 may be located with respect to the first waveguide 10 so that when the probe 28 is inserted, the probe 28 enters the first waveguide 10 at a distance from the closed end 20 of the first waveguide 10 proximate one quarter wavelength of a desired operating frequency, for example, the mid-band frequency of an intended operating frequency band such as Ka or Ku.

Figure 3:
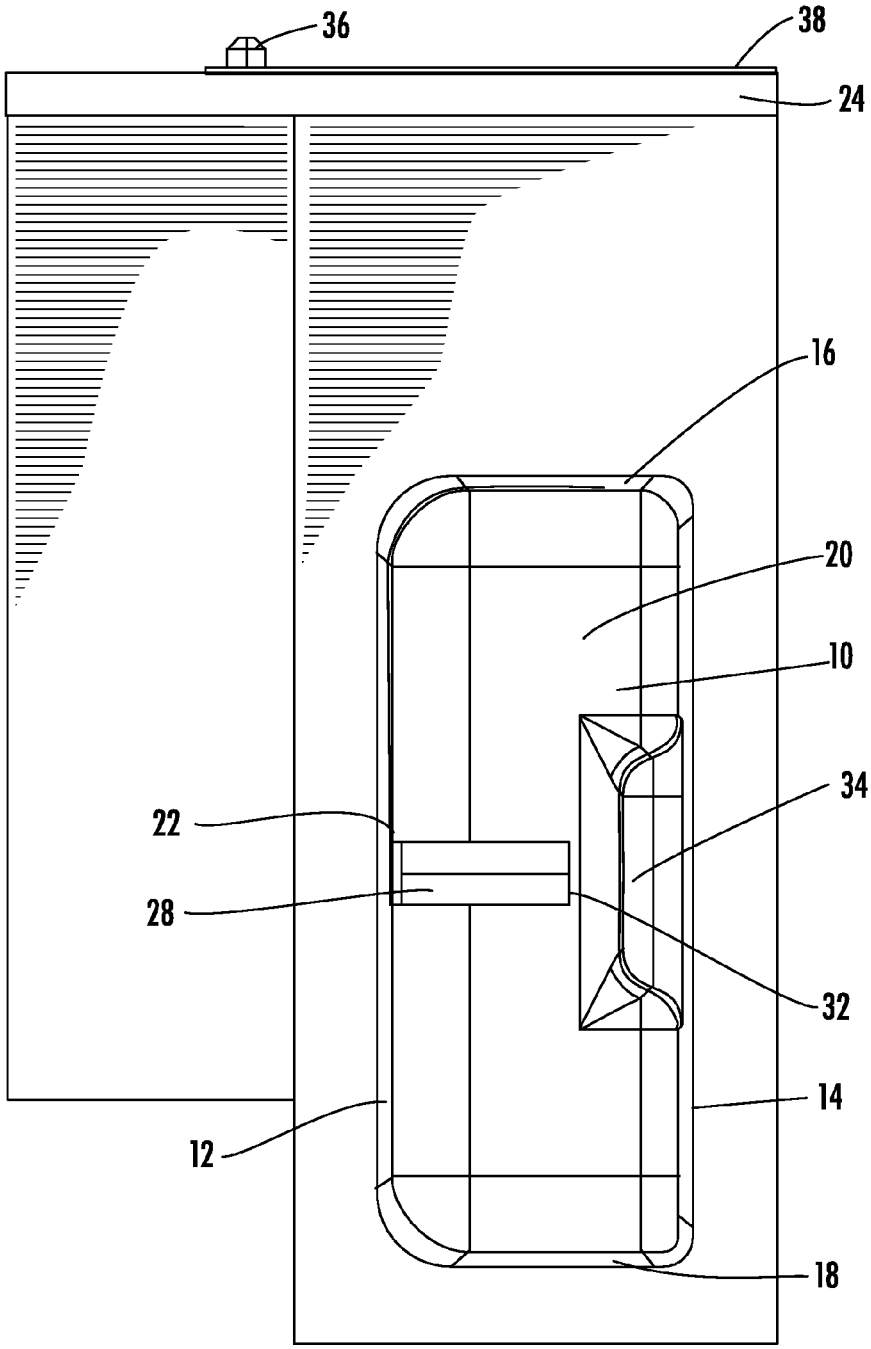
FIG. 3 is a front side isometric view of the transition of FIG. 1, assembled.
Figure 4:
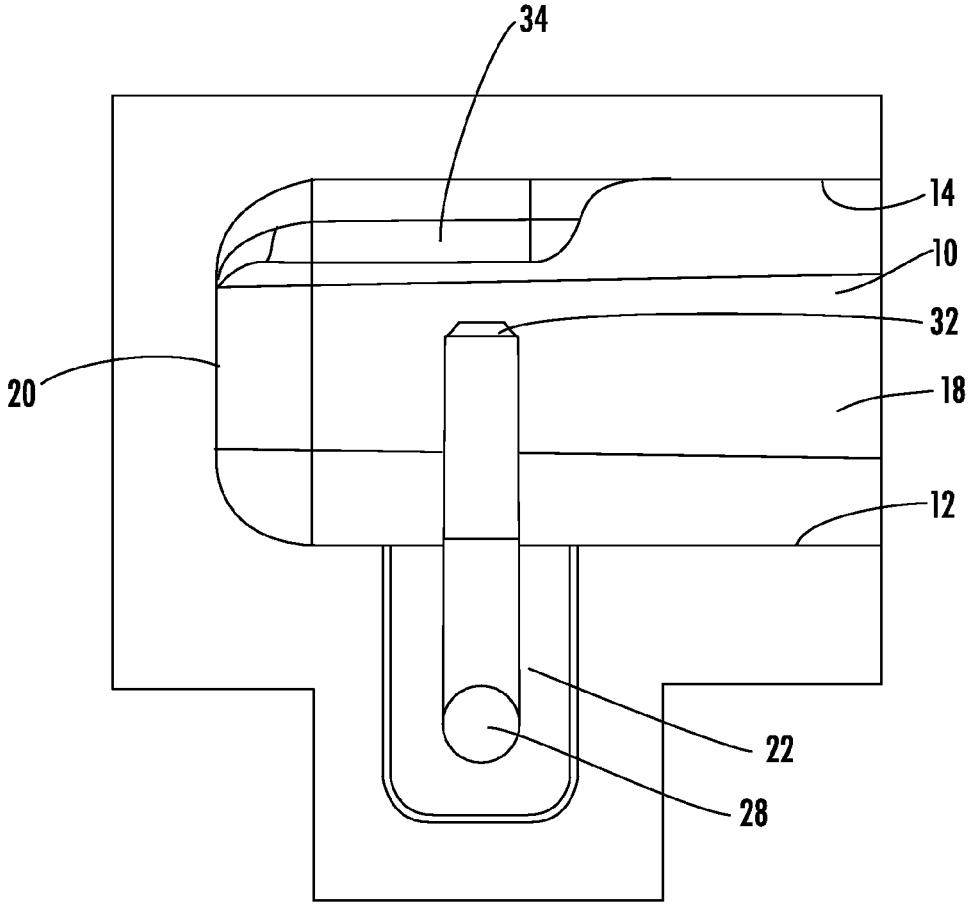
FIG. 4 is a top section view of the transition of FIG. 1, assembled.

The preferred dimensions of the impedance matching feature 34 and distance from the distal end 32 of the probe 28, best shown in FIG. 3, are frequency dependent, derived by empirical testing over a target frequency band. With respect to the Ka band, applicant has found that the impedance matching feature 34 projecting from the bottom 14 may be dimensioned with a cross bottom width of more than three times the diameter of probe 28. The impedance matching feature 34 includes a height and a distance from the distal end 32 of the probe 28 which may each be less than the diameter of probe 28. The impedance matching feature 34 may be localized to the area beneath the distal end of the probe 28 or alternatively may be extended from the position beneath the distal end 32 of the probe 28 to the closed end 20 of the first waveguide 10, as shown in FIG. 4, thereby simplifying die casting of the first waveguide structure. To further simplify manufacture via die casting, the corners and mating edges of the waveguide and impedance matching feature 34 may be rounded.

As the proximal end 36 of the probe 28 passes through the dielectric substrate 24 and couples with the first microstrip 38, an effective loss tangent and dielectric constant in the immediate area of the dielectric substrate 24 surrounding the probe 28 may be reduced by forming one or more hole(s) 40 in the dielectric substrate 24, thereby improving the insertion and or return loss performance of the transition. For example, a single hole 40 may be formed on a side of the probe 28 one hundred and eighty degrees from the first microstrip 38. If desired, two additional hole(s) 40 in the dielectric substrate 24 at plus or minus ninety degrees from the first microstrip 38 may also be formed on either side of the probe 28. These hole(s) 40 may be formed with minimal additional cost during manufacturing of the dielectric substrate 24. Therefore, the resulting performance improvement is very cost effective. Alternatively, a U-shaped slot may be formed around the probe 28 and first microstrip 38 connection for maximum effect.

Figure 5:
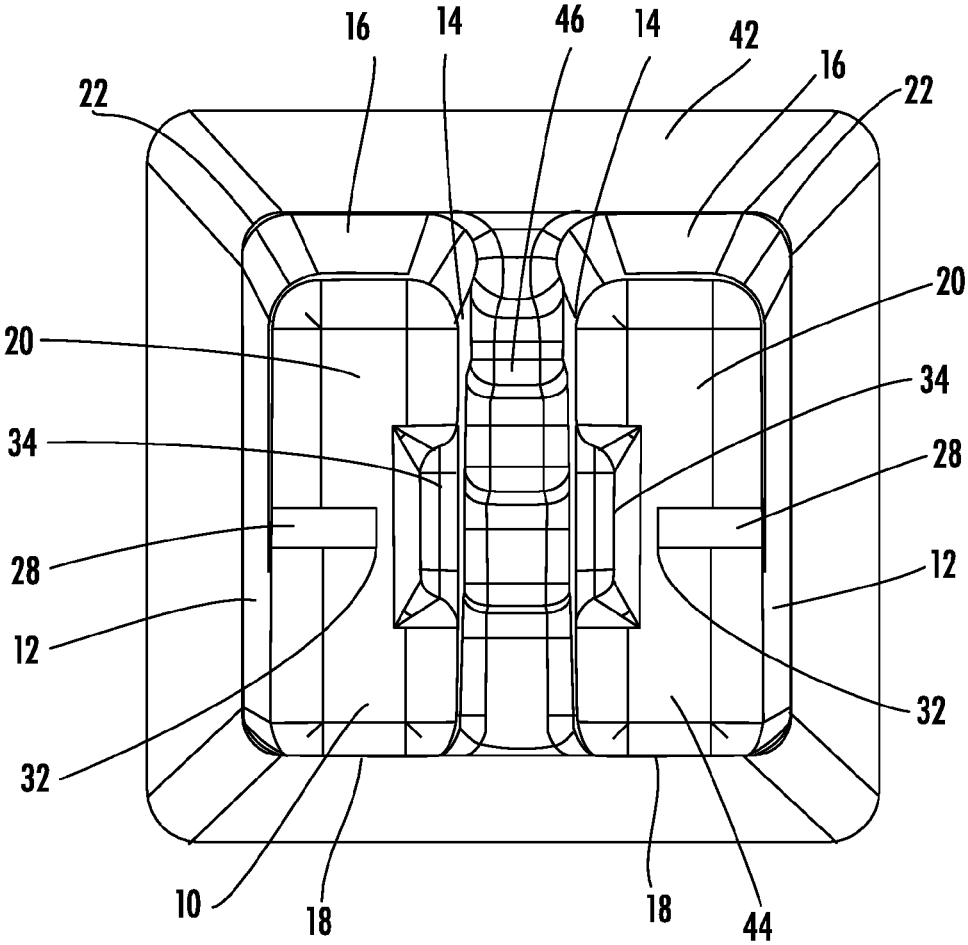
FIG. 5 is a front view of a feed separated into a first and second waveguides by a septum polarizer, each waveguide having a transition according to the exemplary embodiment coupled to a common dielectric substrate (not shown).

One skilled in the art will appreciate that the present invention is particularly beneficial where a feed waveguide 42 is adapted for a circularly polarized input signal that is separated into linear polarizations directed into first and second waveguide(s) 10, 44 by, for example, a septum polarizer 46, as shown in FIG. 5. The first and second waveguide(s) 10, 44 are aligned together in an adjacent mirror configuration, bottom 14 to bottom 14. But for the 90 degree bend 30 of the probe 28, the first and second waveguide(s) 10, 44 would typically each have transitions coupling to separate printed circuit boards at either side of the feed waveguide 42. The 90 degree bend in the probe(s) and rectangular aspect of the transition slot(s) 22 enables addition of a second microstrip to the single dielectric substrate 24 which may then be easily assembled by inserting the respective probe(s) 28 into corresponding transition slot(s) 22 as the dielectric substrate 24 is seated against the mounting surface 26. Accordingly, multiple separate feeds, operating in different frequency bands, of a common feed assembly may be closely spaced together in a compact assembly with high levels of signal isolation due to the ability to group the transitions by frequency band to different printed circuit boards that are isolated from one another by alternating the orientation of the printed circuit boards with respect to selected feeds.

Figure 6:
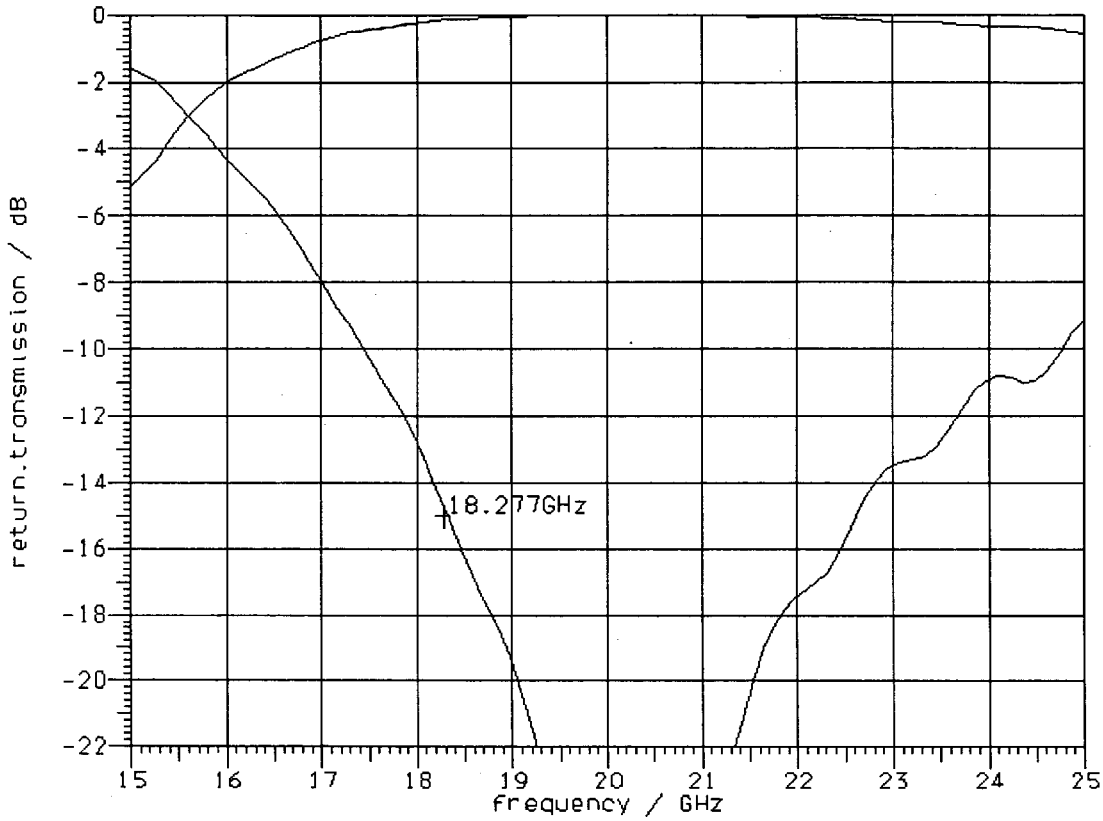
FIG. 6 is a return loss performance simulation chart of a transition according to the invention without an impedance matching feature.
Figure 7:
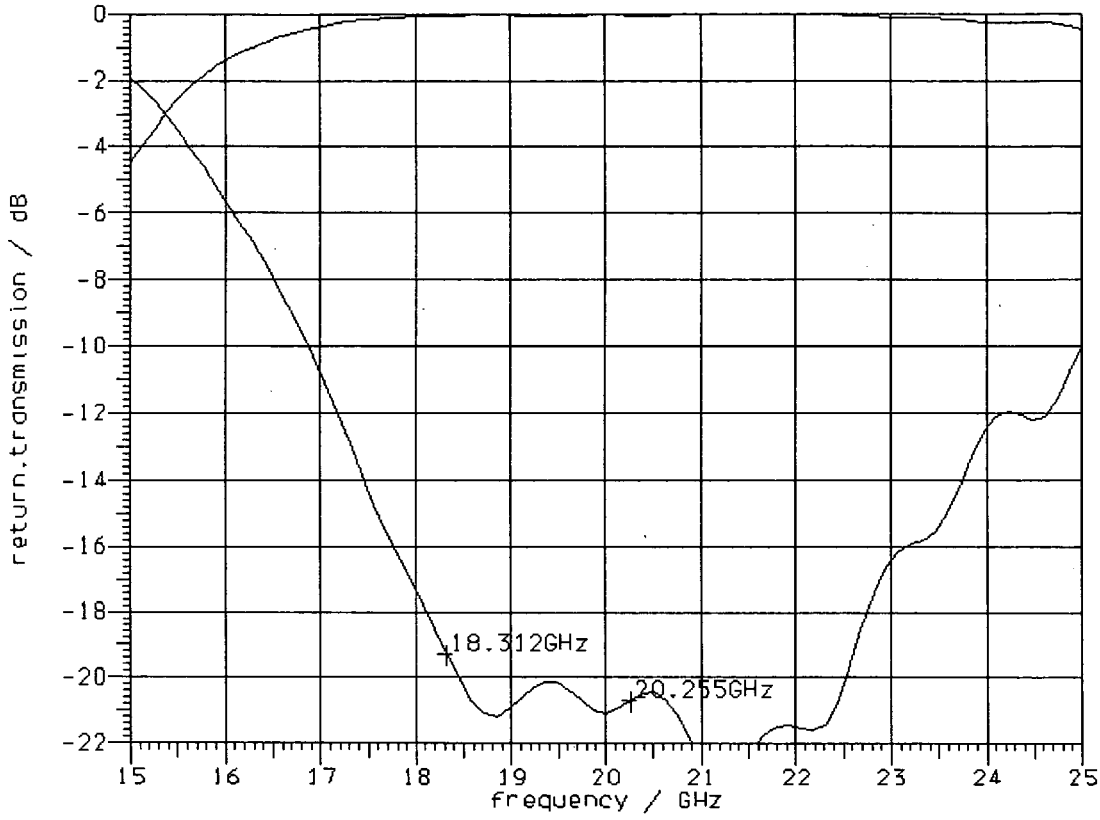
FIG. 7 is a return loss performance simulation chart of a transition according to the invention with an impedance matching feature.

A low loss, improved electrical performance transition according to the invention is adaptable for mass production with a high level of precision via use of die casting and printed circuit board manufacturing methods. Return loss performance simulations of a transition according to the invention without the impedance matching feature 34 and with the impedance matching feature 34, are demonstrated by the charts in FIGS. 6 and 7 respectively.

| Table of Parts | |
|---|---|
| 10 | first waveguide |
| 12 | top |
| 14 | bottom |
| 16 | first sidewall |
| 18 | second sidewall |
| 20 | closed end |
| 22 | transition slot |
| 24 | dielectric substrate |
| 26 | mounting surface |

-continued

| Table of Parts | |
|---|---|
| 28 | probe |
| 30 | bend |
| 32 | distal end |
| 34 | impedance matching feature |
| 36 | proximal end |
| 38 | first microstrip |
| 40 | hole |
| 42 | feed waveguide |
| 44 | second waveguide |
| 46 | septum polarizer |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A waveguide to microstrip transition, comprising:

a first waveguide with a top, a bottom, a first sidewall and a second sidewall; the first waveguide having a closed end;

a transition slot normal to a longitudinal axis of the waveguide intersecting the top and the first sidewall;

a probe having a 90 degree bend arranged in the transition slot, a distal end of the probe projecting into the waveguide normal to the top;

the distal end of the probe proximate an impedance matching feature that projects from the bottom and extends to the closed end;

a proximal end of the probe coupled to a first microstrip on a dielectric substrate.

2. The transition of claim 1, wherein the probe has a circular cross section.

3. The transition of claim 1, wherein the probe is one quarter wavelength of a desired operating frequency from the closed end.

4. The transition of claim 1, wherein the probe extends into the waveguide more than one half the distance between the top and the bottom.

5. The transition of claim 1, wherein the impedance matching feature is at least three times as wide as a diameter of the probe.

6. The transition of claim 1, wherein a second waveguide complementary to the first waveguide is arranged adjacent to the first waveguide bottom to bottom, the second waveguide also having a transition coupled to a second microstrip on the dielectric substrate.

7. The transition of claim 1, wherein the distal end is spaced away from the impedance matching feature by a distance which is less than a diameter of the probe.

8. The transition of claim 1, further including at least one hole in the dielectric substrate proximate the probe.

9. A waveguide to microstrip transition, comprising:

a first waveguide with a top, a bottom, a first sidewall and a second sidewall; the first waveguide having a closed end;

a transition slot normal to a longitudinal axis of the waveguide intersecting the top and the first sidewall;

a probe having a 90 degree bend arranged in the transition slot, a distal end of the probe projecting into the waveguide normal to the top;

the probe, having a circular cross section, is one quarter wavelength of a desired operating frequency from the closed end;

the probe extends into the waveguide more than one half the distance between the top and the bottom;

the distal end of the probe proximate an impedance matching feature projecting from the bottom;

the impedance matching feature extending along the bottom to the closed end;

a proximal end of the probe coupled to a first microstrip on a dielectric substrate; and at least one hole in the dielectric substrate proximate the probe.

10. A waveguide to microstrip transition for a circularly polarized feed, comprising:

a first waveguide and a second waveguide separated by a polarizer adapted to route a first linear polarization and a second linear polarization of the feed into the first waveguide and the second waveguide, respectively;

each of the first waveguide and the second waveguide having a top, a bottom, a first sidewall and a second sidewall; and a closed end; the first waveguide and the second waveguide aligned in a mirror configuration, the bottom of the first waveguide facing the bottom of the second waveguide;

each of the first waveguide and the second waveguide having a transition slot normal to a longitudinal axis of the feed intersecting the top and the first sidewall;

each of the first waveguide and the second waveguide having a probe with a 90 degree bend arranged in the respective transition slot(s), a distal end of each of the respective probe(s) projecting into the first waveguide and the second waveguide, respectively, normal to the respective top(s);

a proximal end of the probe extending from the first waveguide coupled to a first microstrip on a dielectric substrate;

a proximal end of the probe extending from the second waveguide coupled to a second microstrip on the dielectric substrate.

11. The transition of claim 10, wherein the distal end of each of the probe(s) is proximate a respective impedance matching feature projecting from each of the bottom(s).

12. The transition of claim 11, wherein each of the impedance matching feature(s) extends to the closed end of the first waveguide and the second waveguide, respectively.

13. The transition of claim 10, wherein at least one hole is provided in the dielectric substrate proximate each of the coupling of the first waveguide to the first microstrip and the coupling of the second waveguide to the second microstrip.

* * * * *